US005253768A

United States Patent [19]

Traversa et al.

[11] Patent Number: 5,253,768

[45] Date of Patent: Oct. 19, 1993

[54] WIPING BAR AND SUPPORT FOR PAINT BRUSHES

[76] Inventors: Steven J. Traversa; Vito L. Racano, both of 4857 Cahuenga Blvd., North Hollywood, Calif. 91601

[21] Appl. No.: 42,666

[22] Filed: Apr. 5, 1993

[51] Int. Cl.[5] ..... A47F 7/00

[52] U.S. Cl. ..... 211/65; 248/110

[58] Field of Search ..... 211/65, 66; 248/110, 248/113

[56] References Cited

U.S. PATENT DOCUMENTS

| | | | |
|---|---|---|---|
| 602,125 | 4/1898 | Burrows . | |
| 1,176,009 | 3/1916 | Weimar . | |
| 1,392,134 | 9/1921 | Farber . | |
| 2,483,265 | 9/1949 | Dalia | 211/65 X |
| 2,724,570 | 11/1955 | Richardson | 248/113 |
| 2,823,399 | 2/1958 | Stewart | 15/121 |
| 2,936,924 | 3/1958 | Hansen | 211/65 |
| 3,185,311 | 5/1965 | Roberts | 211/66 |
| 3,542,209 | 11/1970 | Thompson | 211/60 |
| 4,101,046 | 7/1978 | Puntillo | 248/110 X |
| 4,266,686 | 5/1981 | Carter | 211/65 X |
| 4,660,245 | 4/1987 | Anderson | 15/268 |
| 4,832,293 | 5/1989 | Gizzi | 248/110 |
| 4,991,803 | 2/1991 | Budder | 238/113 |
| 5,033,704 | 7/1991 | Kerr | 248/110 |
| 5,087,014 | 2/1992 | Desjardin | 248/692 |

*Primary Examiner*—Alvin C. Chin-Shue
*Assistant Examiner*—Sarah A. Lechok
*Attorney, Agent, or Firm*—Woodrow D. English

[57] ABSTRACT

A combination paint wiping bar and rest for a paint brush has a blade edge and a pair of opposing beveled surfaces which act to funnel paint scraped from a brush into the open mouth of a paint can. These surfaces also aid in shaping the bristles into a wedge for the smooth and even application of paint. The bar is held in place over the open mouth of a paint can by means of two spring clips or, in an alternate construction, by use of an undulating rim which mates with the paint can's rim. Handles are provided for installing and removing the paint bar.

8 Claims, 2 Drawing Sheets

WIPING BAR AND SUPPORT FOR PAINT BRUSHES

BACKGROUND

The present invention relates to an armature used for wiping excess paint from a brush and which may be used for supporting the brush. The armature is suspended over the open mouth of a paint can, insuring that paint which is wiped or drips from the brush will fall into the can.

Painters, professional and amateur, frequently soak their brushes directly in the cans used to sell and store paint. This method is more convenient and practical when using brushes than the procedure of transferring the paint to a tray or other container. The disadvantage, however, is that the brush's excess paint must then be wiped against the rim of the can. Some of this paint invariably settles in the trough of the paint can rim or runs down the outside of the can. Paint which pools in the trough of the can rim sprays out when the lid is hammered into place; paint which drips outside the can creates stains.

The present invention is an alternative wiping surface for use with paint cans, and it eliminates the messy technique of wiping brushes against the can's rim. The angled edge of the wiping bar acts as a squeegee as it forces extra paint from the bristles. The wiping bar's beveled surfaces funnel the paint into the can.

A further advantage of the invention is that a paint brush may be rested horizontally, out of the can of paint, when not in use. This prevents the brush from being immersed beyond the bristles in paint and keeps the handle clean and at a convenient grasping location.

The present invention is easily removed for cleaning or use on various paint containers. The paint wiping bar may be easily oriented to not interfere with a carrying bail which may be attached to the paint can.

A lightweight, easily mounted and removed, beveled paint wiping bar would represent an major advance in the paint application and preparation technology and would satisfy a long felt need in the field of using and maintaining paint brushes.

SUMMARY

The present method for wiping excess paint from brushes and supporting brushes not in use solves the above referenced problems and satisfies the noted needs. The present invention offers a simple solution to the problem of painters not having an easily cleaned surface on which to wipe and rest brushes.

The paint wiping bar described herein offers an ideal surface for wiping and shaping the bristles of a paint brush. The bar serves well as a rest for brushes not in use, and keeps the paint can clean. After use, the bar is easily removed for cleaning while allowing the original paint can lid to be replaced.

These and other features, aspects, and advantages of the present invention will become better understood with reference to the following description, appended claims, and accompanying drawings.

DRAWINGS

Figure 1:
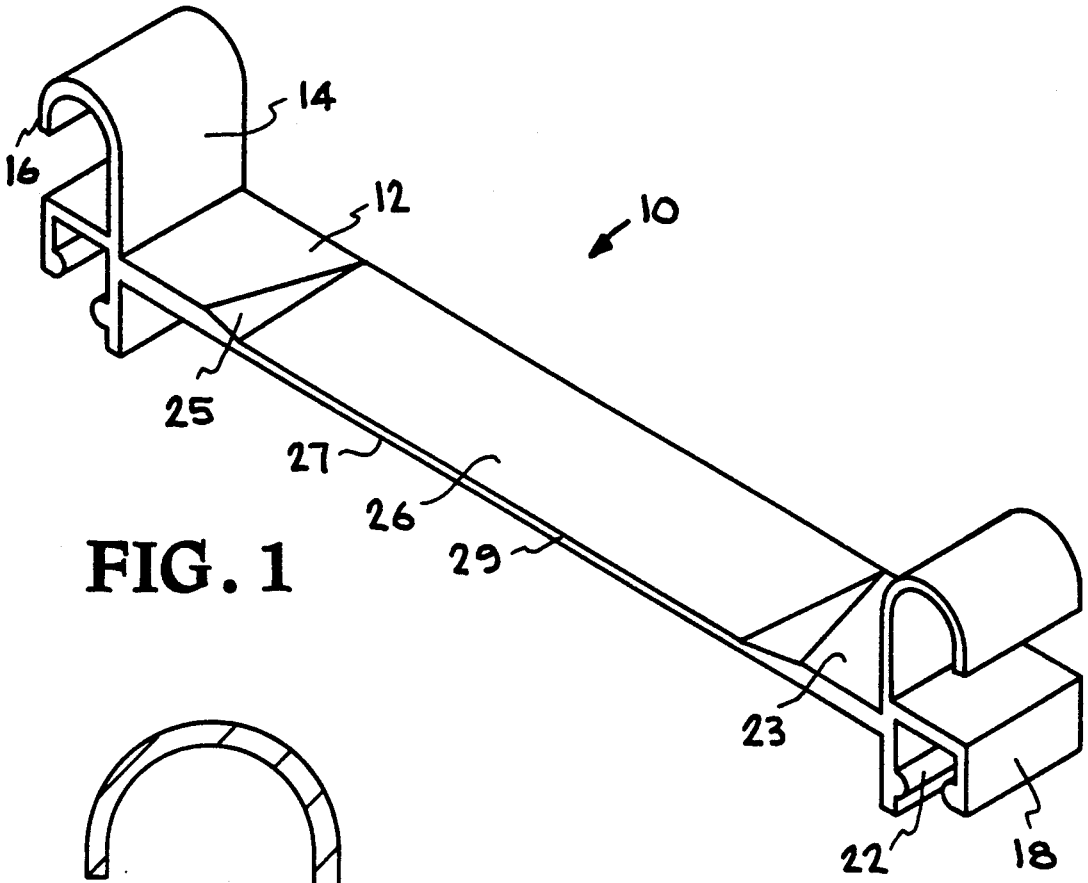

FIG. 1 is a perspective view of the paint wiping bar in its preferred version. The paint can rim clips and handles for installing and removing the bar are visible at both ends of the bar. The angled wiping surface is clearly shown, as are the beveled transitionary surfaces.

Figure 2:
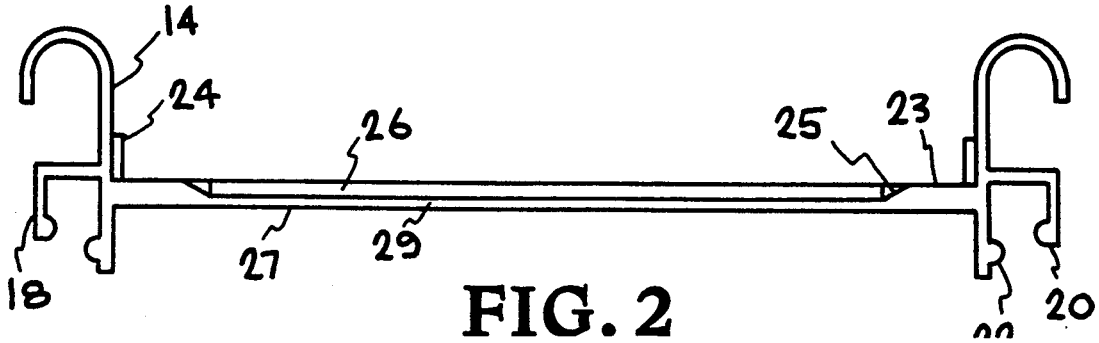

FIG. 2 is a frontal view of the paint wiping bar. The inner and outer rim clips and their respective detents are evident. An optional reinforcing gusset between the paint bar and the handles is shown.

Figure 3:
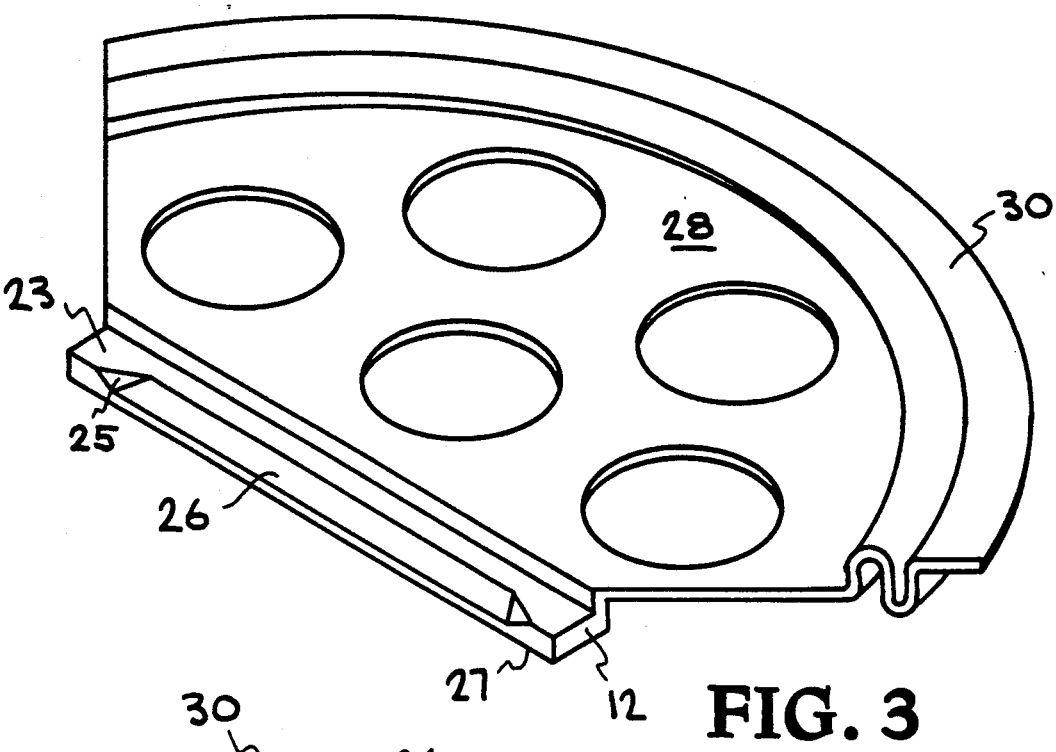

FIG. 3 is a perspective view of an alternative embodiment of the paint wiping bar. The bar and angled wiping surface are both similar to those in FIG. 1. The support and attachment structure, however, consist of a semicircular, multifaceted plate.

Figure 4:
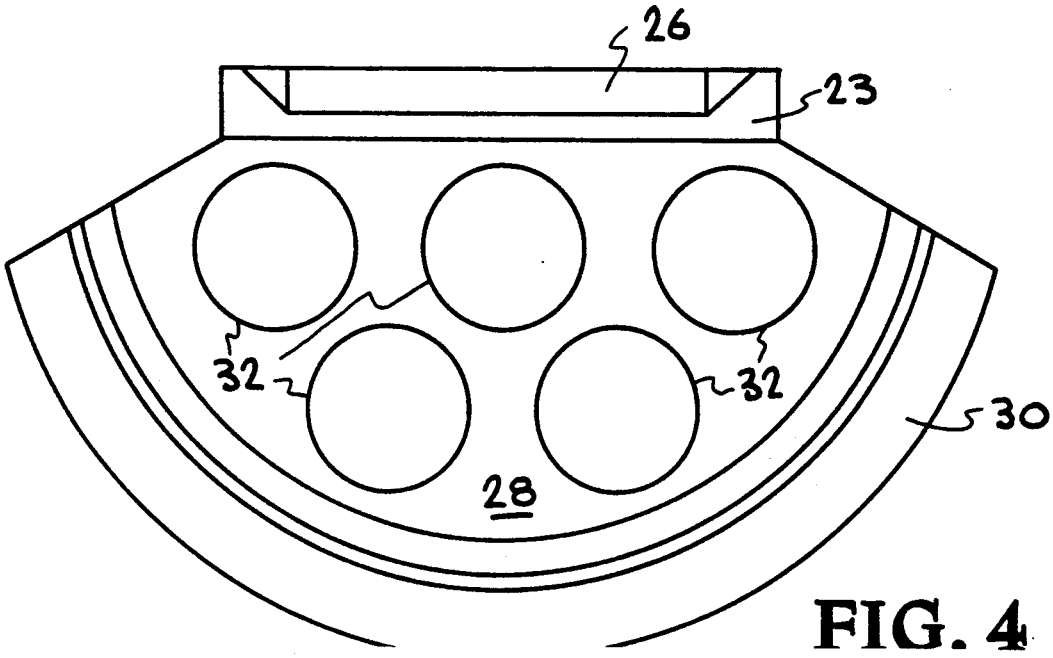

FIG. 4 gives a top view of the alternate support and attachment structure for the paint wiping bar. The paint drain holes in the support structure are shown.

Figure 5:
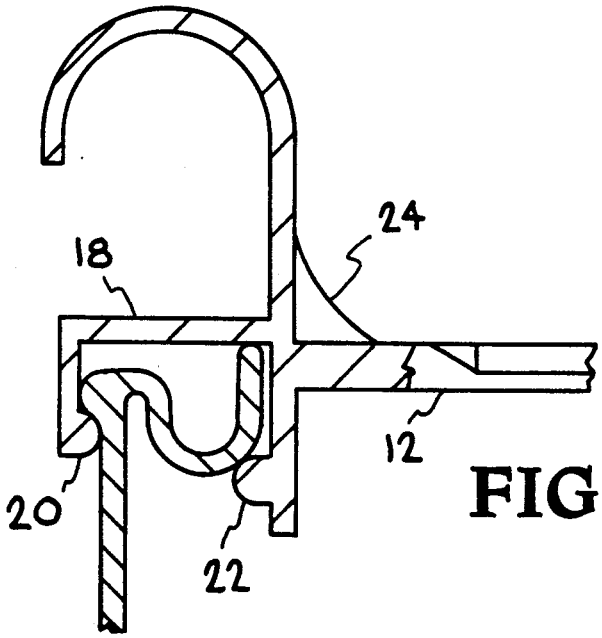

FIG. 5 is an exploded view of the paint can rim and the rim attaching clips of the preferred embodiment of the present invention. The interaction of the clips and the rim, to effect engagement between the detents and the can rim, is shown.

Figure 6:
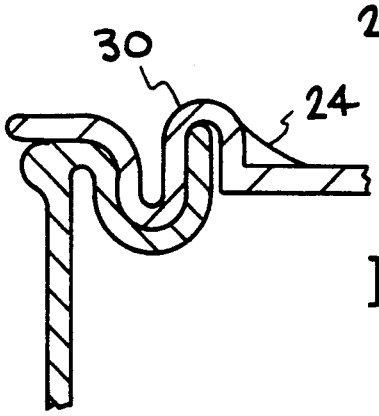

FIG. 6 gives an exploded view of the frictional engagement between the alternate support structure and the paint can rim.

DESCRIPTION

With reference to FIG. 1, a device 10 for wiping paint from a brush is shown in perspective view. The body 12 of the wiping device 10 is slender and has an inner spring clip 14 attached to either end. One end of each of the inner spring clips 14 has a raised inner detent 22. The inner detents 22 are sized so that when the two inner detents 22, one located at either end of the body 12, are simultaneously passed into the interior of a paint can they will cause a deflection of their respective inner detent clips 14. The ends of the inner spring clips 14 opposing those ends containing the detents 22 terminates in handles 16. The handle 16 is a result of the inner spring clip 14 being bent distally to form a semicircular handle 16. The handle 16 is sized to contain the finger of a user's hand.

The paint wiping body 12 has a bottom surface 27 which lies horizontal when the device 10 is installed in a paint can. An angled wiping surface 26 meets the bottom surface 27 at an angle of less than about 60° to form the wiping edge 29. The preferred wiping surface 26 does not extend the length of the body 12, but meets two transition beveled surfaces 25 which connect the wiping surface 26 and a top surface 23. The top surface 23 and bottom surface 27 lie in a generally parallel plane. The preferred wiping surface 26 and the transition beveled surfaces 25 combine to form a trapezoidal funnel for guiding the flow of paint. This angled surface 26 is also designed to shape the bristles into the desired wedge which most painting requires.

FIG. 2 is an end view of the paint wiping device 10. The top surface 23, bottom surface 27, wiping surface 26, transitional beveled surfaces 25, and the wiping edge 29 are clearly shown as are their relationships to each other. Opposing outer spring clips 18 and their respective outer detents 20 lie adjacent to the inner spring clips 14 and inner detents 22. The outer detents 20 are sized and located appropriately to deflect the outer spring clips 14 when the outer detents 20 simultaneously passed around a paint can rim. A support gusset 24 may be located at the juncture between the body 12 and the inner spring clips 14. The gusset 24 may be rectangular, triangular, or curved in cross section and is designed to reduce stress at the intersection between the body 12 and the inner spring clip 14. The device 10 is made so that the inner spring clips 14 and outer spring clips 18 will mate with any predetermined size paint can.

FIG. 3 is an alternate embodiment of the present paint wiping device 10. This embodiment incorporates the wiping body 12 with its bottom surface 27, top surface 23, angled face 26, and beveled transition faces 25. The support structure 28 for this embodiment is a semicircular plate with an undulating perimeter 30. The undulating perimeter 30 is shaped to effect a frictional hold on the rim of a standard paint can.

FIG. 4 shows that the semicircular support frame 28 has a number of paint drain holes 32. These holes are so that a paint brush may rest on the support structure 28 and excess paint will not pool on the structure 28, but pass through the drain holes 32 into the paint can below. The paint wiping device 10 may be made in any size, but will preferably have dimensions such that the undulating rim 30 interlocks with the rims of one of the standard pint, quart, gallon, or five gallon cans. The paint wiping device 10 may be stamped out of metal, or molded using plastic or reinforced paper. The paint wiping body 12 is located either at the same elevation as the support body 28, or is offset.

FIG. 5 is an exploded view of the preferred embodiment of the present invention as it interacts with the rim of a standard paint can. The inner spring clip 14 and the inner detent 22 are located inside the mouth of the paint can. The outer spring clip 18 projects distally from either end of the body 12, then makes a right angle turn and terminates with an outer detent 20. The outer detent 20 forces the outer spring clip 18 to deflect as the outer detent 20 passes around the paint can rim. The force required to deflect both the inner spring clip 14 and the outer spring clip 18 as the inner detent 22 and the outer detent 20 pass over the paint can rim maintains the paint wiping device 10 in position over the mouth of the paint can. An alternate support gusset 24 having a curved cross section is shown.

FIG. 6 shows a cross section of the interaction between the undulating rim 30 of the alternate embodiment of the present invention. Friction between the undulating rim 30 and the paint can rim cause the wiping body 12 to be held in place over the can's mouth. The reinforcing gusset 24 is triangular in cross section in order to minimize stress concentration between the wiping body 12 and the undulating rim 30.

The invention now being fully described, it will be apparent to one of ordinary skill in the arts that many changes and modifications can be made without departing from the spirit or scope of the present invention.

What is claimed is:

1. A device for wiping excess paint from a brush comprising:

a paint wiping body having a top face, a blade face, a bottom face, a multiplicity of opposing beveled edges, a first support end, and a second support end, wherein said blade face forms an acute angle with respect to said bottom face, and wherein said beveled edges form a pyramidal section with respect to said blade face and said top face;

a plurality of inner spring clips, said inner spring clips having an inner detent, said inner spring clips being affixed to said first end of said body and to said second end of said body in a generally perpendicular orientation;

a plurality of paint container outer rim clips, said outer rim clips having an outer detent, said outer rim clips and said inner rim clips oriented such that said outer rim detents and said inner rim detents substantially oppose each other; and wherein said inner and outer detents may force expansion of said inner and said outer rim clips to entrap a rim of a paint can, thereby containing said paint wiping body generally within said paint can rim.

2. The device of claim 1 wherein said inner spring clips have a handle, said hand located distally along said spring clip from said inner detent said handles located at said first support end and said second support end.

3. The device of claim 1 wherein said outer rim clip is a plate having a generally right angle, said outer detent being contained in the interior angle of said outer rim clip.

4. The device of claim 1 wherein said outer rim clip is a generally undulating plate, outer rim clip shaped such that the contour of a paint can is held in close contact with said undulating plate.

5. A device for wiping excess paint from a brush comprising:

a paint wiping body having a top face, a blade face, a bottom face, a multiplicity of opposing beveled edges, and a semicircular support structure having a plurality of drain holes, wherein said blade face forms an acute angle with respect to said bottom face, and wherein said beveled edges form a pyramidal section with respect to said blade face and said top face;

an undulating rim, said undulating rim being integral to said semicircular support structure and located at the periphery of said semicircular support structure, wherein said undulating rim forms a frictional bond with the rim of a paint can.

6. The device of claim 5 wherein said body defines a chord of said semicircular support structure.

7. The device of claim 5 wherein said paint wiping device is pressed paper composite.

8. The device of claim 5 wherein said paint wiping device is molded of plastic.

* * * * *